United States Patent [19]

Lewallyn

[11] Patent Number: 4,484,505

[45] Date of Patent: Nov. 27, 1984

[54] CARPET BEVELING HEAD DEVICE

[76] Inventor: Michael A. Lewallyn, P.O. Box 1361, Dalton, Ga. 30720

[21] Appl. No.: 457,966

[22] Filed: Jan. 14, 1983

[51] Int. Cl.[3] ..... B26D 3/02

[52] U.S. Cl. ..... 83/869; 83/564; 83/672; 83/699

[58] Field of Search ..... 83/869, 672, 699, 564; 409/138; 30/240, 206; 26/15 R, 8 C, 10 C

[56] References Cited

U.S. PATENT DOCUMENTS

| | | | |
|---|---|---|---|
| 361,563 | 4/1887 | Willcox | 26/15 L |
| 1,147,088 | 7/1915 | Haas | 26/15 R |
| 2,173,613 | 9/1939 | Richardson | 26/15 L |
| 3,077,654 | 2/1963 | Hadley | 26/15 R |
| 3,866,501 | 2/1975 | Glendenning et al. | 83/699 |

FOREIGN PATENT DOCUMENTS

| | | | |
|---|---|---|---|
| 1002278 | 2/1957 | Fed. Rep. of Germany | 26/15 R |

*Primary Examiner*—James M. Meister
*Attorney, Agent, or Firm*—Jones & Askew

[57] ABSTRACT

An improved carpet beveling head wherein a pivotally mounted cutting blade is retained in operative engagement with a rotary cutter. The pivotal mounting, which facilitates adjustment of the device, is retained in such position by exertion of a securing end pressure thereon.

6 Claims, 5 Drawing Figures

CARPET BEVELING HEAD DEVICE

TECHNICAL FIELD

The present invention relates to beveling the edge of a woven fabric, and more particularly relates to an improved apparatus for beveling the edge of a carpet sample.

BACKGROUND OF THE INVENTION

A carpet beveling head, as known in the art of carpet manufacture, is a device wherein a power-driven, multi-edged rotary cutter acts in combination with a stationary cutting blade to engage the edge of a section of carpet. Proper and efficient operation of a carpet beveling head calls for the cutting edges of the stationary blade and the rotary cutter to be positioned so as to tangentially engage each other and shear, in a scissor-like manner, the pile portion of a carpet edge. Such an operation trims the carpet edge and gives the carpet section an aesthetically pleasing appearance. For these reasons, carpet samples are so treated for use by sales persons and retail outlets.

Normal use of a carpet beveling head produces certain problems. One such problem is a deflection of the stationary cutting blade away from the rotary cutter. Such deflecton destroys the necessary tangential relationship between the respective cutting edges and thus results in inefficient operation of the device. Prior art devices have traditionally utilized two adjusting screws to exert a downward pressure and a third adjusting screw to exert an upward pressure against the stationary cutting blade in an attempt to force the cutting edges together. (An example of such a device is the table model bevel edge trimming machine manufactured by B & J Machinery Company, Inc., York Street, Dalton, Ga.) Such an arrangement actually compounds the deflection problem as the stationary cutting blade arcs away from the rotary cutter.

A further problem in the prior art is the extreme difficulty encountered in adjusting the stationary cutting blade to compensate for deflection. A skilled and experienced mechanic requires an inordinate amount of time to manipulate the adjusting screws so as to properly position the stationary cutting blade relative to the rotary cutter to provide maximum shearing action.

SUMMARY OF THE INVENTION

The present invention solves the above-described problems in the prior art by providing a carpet beveling head that maintains the proper tangential relationship between the cutting edges of the rotary cutter and stationary cutting blade in such manner as to reduce deflection of the stationary cutting blade to a minimum. The present invention further provides for simple and quick adjustment of the stationary cutting blade to restore the proper tangential relationship between the cutting edges to provide maximum shearing action.

Generally described, the improved carpet beveling head of the present invention comprises a supporting body, a rotary cutter mounted within said supporting body, a stationary cutting blade and means for carrying the stationary cutting blade, wherein the stationary cutting blade is pivotally retained in the proper position relative to the rotary cutter so as to bevel the edge of a carpet section.

Stated somewhat more specifically, the present carpet beveling head further comprises an elongate carrier member to which the stationary cutting blade is secured. The carrier member is mounted within the supporting body by a threaded member extending therethrough and received by the supporting body. Rotation of the threaded member draws the supporting body against the carrier member, thereby causing a pinching pressure to be brought to bear against the outermost ends of the carrier member by the supporting body. Thus, the position of the carrier member is maintained and, in turn, the stationary cutting blade is retained in a proper position without any surface pressure being exerted thereon.

Thus, it is an object of the present invention to provide an improved carpet beveling head.

It is a further object of the present invention to provide a carpet beveling head wherein the stationary cutting blade is retained in tangential engagement with the rotary cutter without exertion of a surface pressure on the stationary cutting blade.

It is a further object of the present invention to provide a carpet beveling head that provides for simple and quick adjustment of the stationary cutting blade.

It is a yet further object of the present invention to provide a carpet beveling head that permits proper adjustment of the stationary cutting blade without need of a specially skilled or trained mechanic.

Other objects, features and advantages of the present invention will become apparent from reading the following specification when taken in conjunction with the following drawing.

DETAILED DESCRIPTION OF A PREFERRED EMBODIMENT

Figure 1:
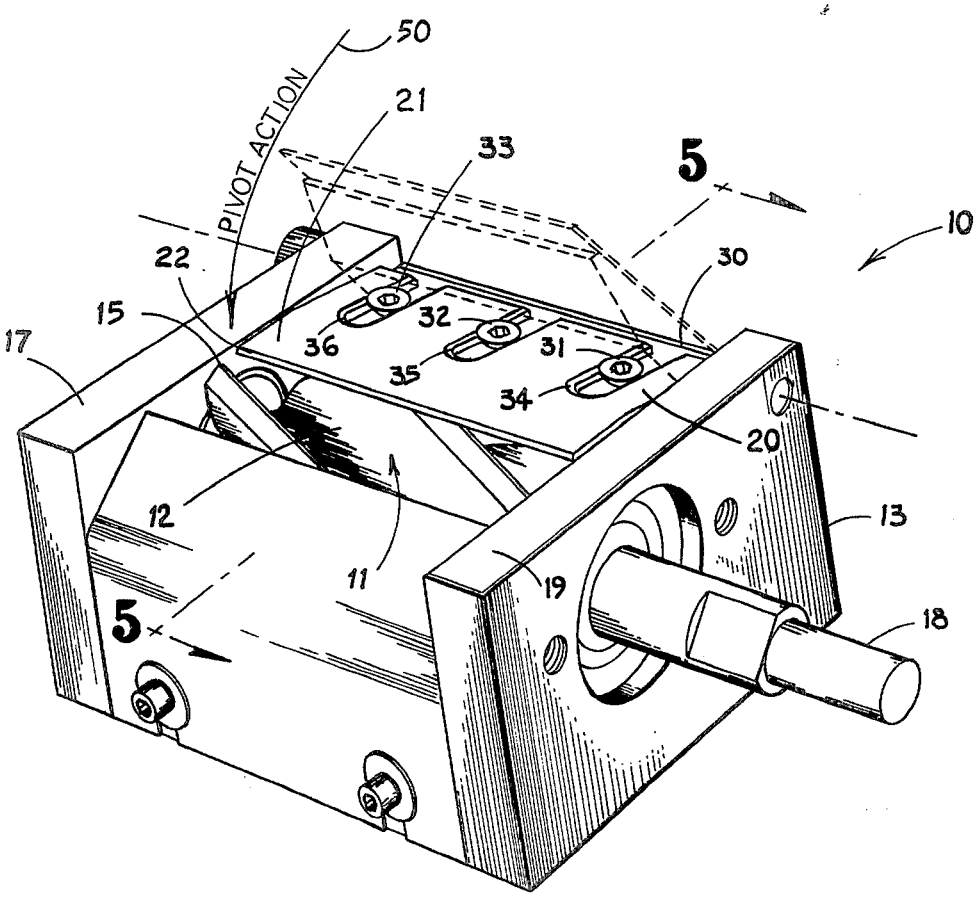
FIG. 1 is a pictorial view of an embodiment of the carpet beveling head according to the present invention, with an alternate position of the pivotable carrier member shown in phantom.
Figure 2:
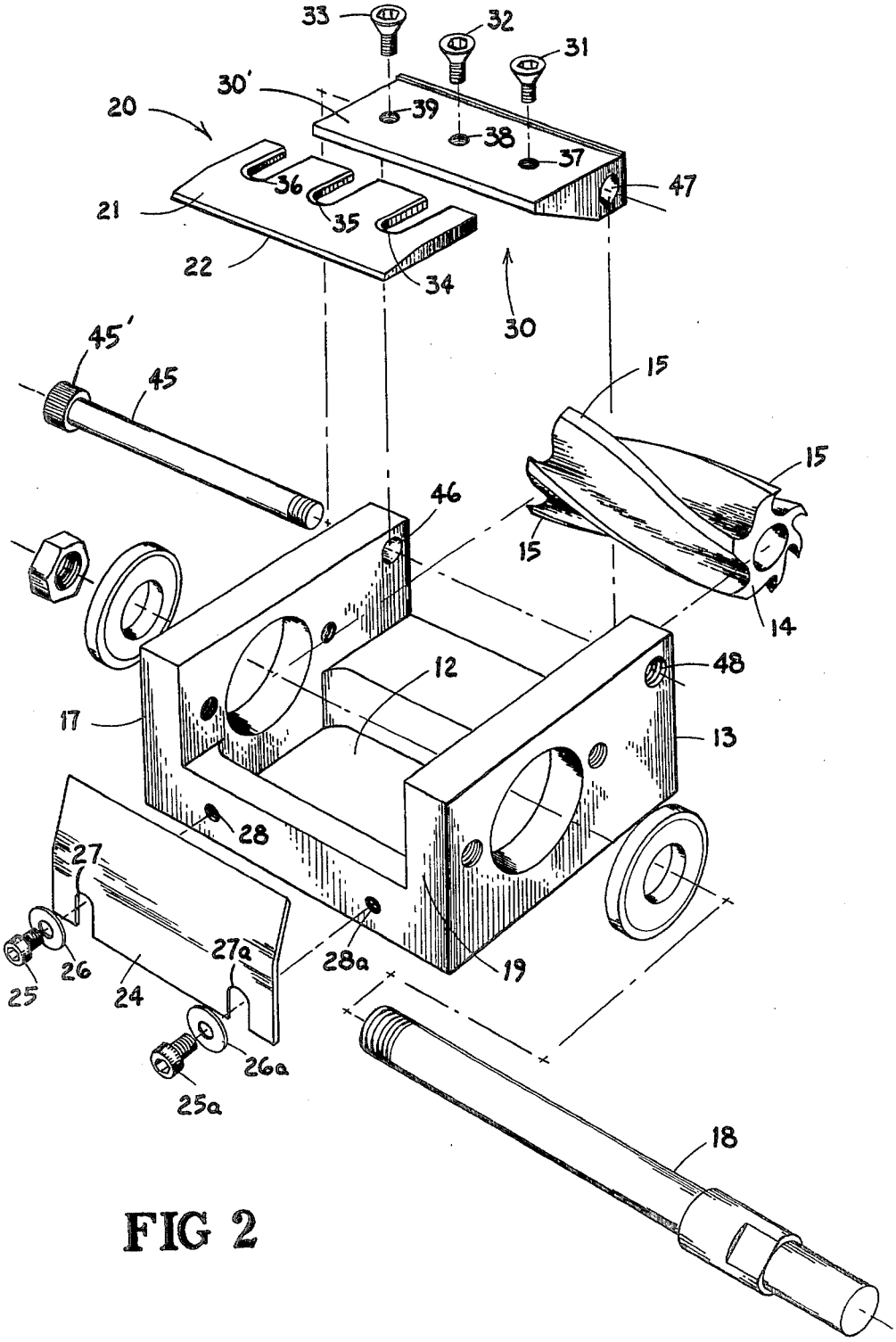
FIG. 2 is an exploded pictorial view of the embodiment shown in FIG. 1.

Referring now in more detail to the drawing, in which like numerals indicate like parts throughout the several views, FIG. 1 shows a carpet beveling head 10 according to the present invention having a power-driven rotary cutter 11 mounted upon or otherwise secured within an opening 12 defined by the supporting body 13. The supporting body 13 may be made of steel, iron, or any other rigid material of suitable strength to house the rotary cutter 11.

The rotary cutter 11 comprises a cutting head 14 having a plurality of helical cutting edges 15 which substantially traverse the length of the opening 12 defined by a left-hand wall 17 and a right-hand wall 19 of the supporting body 13. The cutting head 14 may be formed of aluminum or steel or any like material suitable for shearing carpet pile. The rotary cutter 11 further comprises an outwardly extending shaft 18 which engages the drive mechanism of a carpet beveling and trimming machine in the usual and well-known manner (not shown).

The carpet beveling head 10 further has a stationary cutting blade 20 comprising a beveled face 21 and a cutting edge 22. It will be appreciated by those skilled in the art that the stationary cutting blade 20 tangentially contacts the power-driven rotary-cutter to create a scissor-like action therebetween. Thus, the stationary cutting blade 20 may also be formed of aluminum or steel or any like material suitable for shearing carpet pile. When positioned for cutting, the stationary cutting blade 20 extends across the opening 12 of the supporting body 13 so as to place the cutting edge 22 thereof against a cutting edge 15 of the rotary cutter 11. As the action of the respective cutting edges 15 and 22 shear the carpet pile, the beveled surface 21 serves to deflect sheared carpet away from the cutting area to prevent any accumulation of sheared carpet pile. The operator is protected from the shearing action of the carpet beveling head by a guard plate 24. The guard plate 24 is secured to the supporting body 13 by two threaded members 25 and 25*a* freely extending through two washers 26 and 26*a*, then extending through two vertically aligned slots 27 and 27*a* in the guard plate 25, and finally received by two threaded apertures 28 and 28*a* in the supporting body 13.

The stationary cutting blade 20 is secured to the top surface 30' of a carrier member 30 by three fastening members 31, 32 and 33 which are located within and freely extend through three slots 34, 35 and 36 in the rear portion of the stationary cutting blade 20, and are threadably received by three apertures 37, 38 and 39 within the carrier member. It is to be understood that the fastening members 31, 32 and 33 exert only a restraining force against the stationary cutting blade 20 and serve only to secure the stationary cutting blade to the carrier member 30. Thus, the fastening members 31, 32 and 33 may comprise retaining screws.

Figure 3:
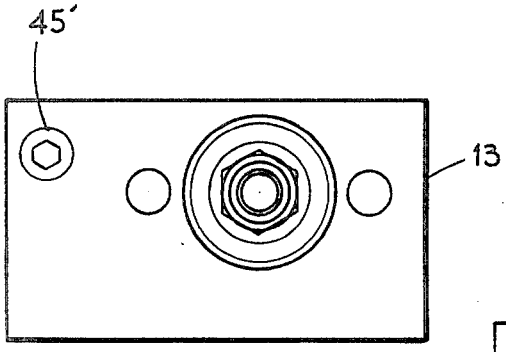
FIG. 3 is a left end view of the embodiment shown in FIG. 1.
Figure 4:
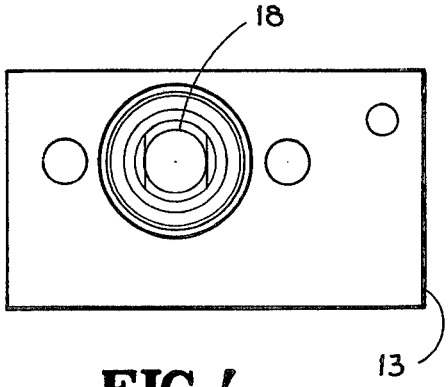
FIG. 4 is a right end view of the embodiment shown in FIG. 1.
Figure 5:
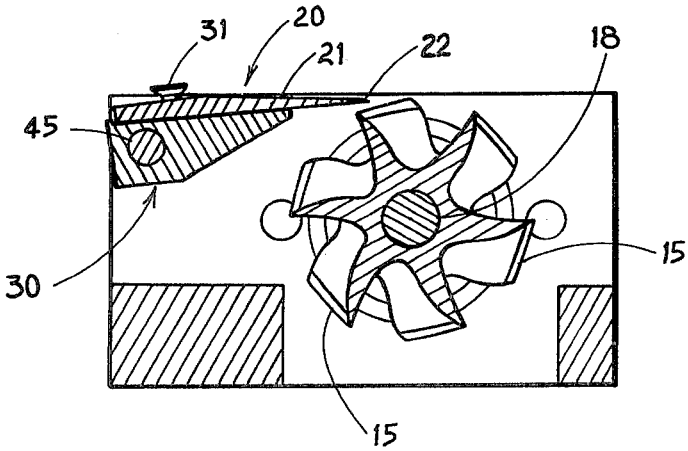
FIG. 5 is a section view of the embodiment shown in FIG. 1, taken along line 5—5 thereof.

The carrier member 30 comprises a horizontally extending bar and may be formed of steel, aluminum or any like material suitable to support the stationary cutting blade 20. In combination therewith, the carrier member 30 substantially traverses the opening 12 defined by the supporting body 13. The carrier member 30 is pivotally mounted upon the supporting body 13 by a threaded member 45 rotatably mounted upon and freely extending through an opening 46 in the left-hand wall 17 of the supporting body 13, then through a lateral aperture 47 extending the entire length of the carrier member, and finally threadably received by an opening 48 in the right-hand wall 19 of the supporting body 13. As best shown in FIG. 3, a head portion 45' is provided having suitable adaptation for a suitable tool such as an Allen wrench or the like to facilitate rotation of the threaded member 45. Thus, a proper end-pressure may be obtained by a clockwise rotation of the head portion 45' of threaded member 45 without great physical effort. As the threaded member 45 is screwed into the threaded opening 48 in the wall portion 19 of the supporting body 13, the head portion 45' of the threaded member engages the other wall portion 17. The resulting inward forces on the two walls 17 and 19 deflect these walls inwardly, sufficiently to engage and immobilize the carrier member 30. The carrier member 30, with the stationary blade 20 retained thereto, is thus selectably clamped between the walls 17 and 19 by the force exerted on the ends of the carrier member. Threaded member 45 may also be threadably received by a nut so as to exert additional pressure against the right-hand wall 19 of the supporting body 20. An alternative construction further contemplates a unitary structure wherein the stationary cutting blade also comprises the carrier member. However, such a construction is not preferred because replacement thereof would be less convenient and, of necessity, made at greater expense than replacement of a stationary cutting blade as described.

One skilled in the art will recognize the present invention to be advantageous over prior art devices because deflection of the blade is reduced to an absolute minimum. The preferred embodiment exerts no uneven surface pressure against the stationary blade 20 that had, heretofore, compounded the deflection problem. As described hereinabove, fastening members 31, 32 and 33 exert only a retaining force against the stationary cutting blade 20 so as to secure it to the carrier member 30. An end-pressure is exerted on the carrier member 30 by the walls 17 and 19 of the supporting body 13 (the degree of which may be increased or decreased through rotation of the threaded member 45) to maintain the stationary cuttng blade 20 in proper cutting position. This constant and even end-pressure minimizes deflection of the stationary cutting blade 20 which results from normal use of a carpet beveling head and, furthermore, eliminates deflection occurring as a result of uneven surface pressure exerted on the stationary cutting blade 20 by prior art devices.

One skilled in the art will recognize the present invention to be further advantageous over prior art devices in that the stationary cutting blade 20 may be easily adjusted without need of any special training. As shown in FIG. 1 and described hereinabove, the carrier member is pivotally mounted within the supporting body 13 having a pivot axis about threaded member 45. Thus, adjustment of the present invention is accomplished by first rotating threaded member 45 in a counterclockwise manner so as to loosen the carrier member 30 from the end-pressure of the walls 17 and 19 of the supporting body 13. Such loosening of the carrier member 30 frees the carrier member, together with the cutting blade 20 attached thereto, to pivotally move about threaded member 45 as shown in phantom and illustrated by arc 50 in FIG. 1. A pressure is then exerted on the surface of the stationary cutting blade 20 by hand, for example, two fingers placed between the slots 34, 35 and 36, so as to position the stationary cutting blade's edge 21 into tangent contact with an edge 15 of the rotary cutter 11. Before releasing such pressure from the stationary cutting blade 20, the threaded member 45 is tightened by a clockwise rotation thereof to again exert an end-pressure upon the carrier member 30, thereby securing the carrier member 30 and, in turn, the stationary cutting blade 20, in the proper position.

It should be understood that the foregoing relates only to a preferred embodiment of the present invention and that numerous modifications or alterations may be made therein without departing from the spirit and scope of the invention as set forth in the appended claims.

I claim:

1. A carpet beveling apparatus comprising:

a support body having a first wall portion and a second wall portion defining an opening therebetween, at least one of said wall portions being deformable;

a rotary cutter carried within said supporting body so as to be disposed laterally within said opening;

a pivotally mounted carrier member having two outermost end portions and an elongated aperture extending lengthwise between said end portions;

an adjustable stationary cutting blade secured upon said carrier member so as to traverse said opening defined between said first wall portion and said second wall portion and be in operative engagement with said rotary cutter; and means for deforming said first wall portion relative to said second wall portion so as to exert a securing end-pressure against said outermost end portions of said carrier member and retain said stationary cutting blade in operative engagement with said rotary cutter, whereby a constant rotational pressure is applied across the length of said stationary cutting blade to prevent deflection thereof.

2. The carpet beveling apparatus of claim 1, wherein said means for deforming said first wall portion relative to said second wall portion comprises a threaded member that extends freely through said elongated aperture in said carrier member and is selectably rotatable to exert an inward pressure against both said first wall portion and said second wall portion.

3. The carpet beveling apparatus of claim 1, wherein a plurality of retaining members interconnect said stationary cutting blade and said carrier member.

4. The carpet beveling apparatus of claim 1, further comprising a guard plate secured to said supporting body.

5. The carpet beveling apparatus of claim 2 wherein said threaded member is rotatably mounted upon and freely extends through said first deformable wall portion of said supporting body, freely extends through said elongated aperture in said carrier member, and is threadably received by said second deformable wall portion of said supporting body, whereby rotation of said threaded member exerts a securing pressure on both of the outermost ends of said carrier member so as to retain said carrier member in a fixed position.

6. An improved carpet beveling apparatus comprising:

a supporting body having a first deformable wall portion and a second deformable wall portion defining an opening therebetween;

a rotary cutter having a plurality of cutting edges depending from said first deformable wall portion and said second deformable wall portion so as to be mounted within said opening;

a pivotally mounted carrier member having two outermost end portions and an elongated aperture extending lengthwise therebetween, said carrier member being dimensioned for receipt within said opening;

a stationary, adjustable, substantially flat cutting blade traversing said opening defined by said supporting body having a beveled top surface and secured to said carrier member by a plurality of retaining members in operative engagement with said rotary cutter; and a rotatably mounted threaded member freely extending through an opening within said first wall portion, further freely extending through said elongated aperture within said carrier member, and finally threadably received by a threaded opening in said second wall portion of said supporting body, thus defining an axis about which said carrier member pivots, wherein said cutting blade is readily rotated into operative engagement with said rotary cutter so as to apply a constant force against the length of said cutting blade, and clockwise rotation of said threaded member causes said first wall portion to be deformed relative to said second wall portion to exert a securing pressure against said outermost ends of said carrier member and retain said stationary cutting blade in operative engagement with said rotary cutter, and counterclockwise rotation of said threaded member releases said carrier member to permit adjustment of said cutting blade relative to said rotary cutter without requiring adjustment of said cutting blade relative to said supporting body.

* * * * *